United States Patent [19]

Hudson et al.

[11] 4,055,782

[45] Oct. 25, 1977

[54] METHOD OF ENHANCING CYCLOTRON BEAM INTENSITY

[75] Inventors: Ed D. Hudson, Knoxville, Tenn.; Merrit L. Mallory, East Lansing, Mich.

[73] Assignee: The United States of America as represented by the United States Energy Research and Development Administration, Washington, D.C.

[21] Appl. No.: 789,765

[22] Filed: Apr. 22, 1977

[51] Int. Cl.[2] ..... H05H 7/08; H05H 13/00

[52] U.S. Cl. ..... 315/111.9; 313/62; 313/362; 328/234

[58] Field of Search ..... 313/362, 231.4, 62; 328/234; 315/111.8, 111.9

[56] References Cited

U.S. PATENT DOCUMENTS

| | | | |
|---|---|---|---|
| 3,226,598 | 12/1965 | Van Nimwegen | 313/362 X |
| 3,566,185 | 2/1971 | Gavin | 315/111.9 |
| 3,898,496 | 8/1975 | Hudson et al. | 313/362 X |

OTHER PUBLICATIONS

"High Performance Heavy-ion source for cyclotrons", by E. D. Hudson et al., Article from 1971 particle accelerator conference, accelerator engineering and technology, Chicago, Illinois, Mar. 1-3, 1971, pp. 113-117.

*Primary Examiner*—Palmer C. Demeo

*Attorney, Agent, or Firm*—Dean E. Carlson; Stephen D. Hamel; Louis M. Deckelmann

[57] ABSTRACT

When an easily ionized support gas such as xenon is added to the cold cathode in sources of the Oak Ridge Isochronous Cyclotron, large beam enhancements are produced. For example, $^{20}Ne^{7+}$is increased from 0.05 enA to 27 enA, and $^{16}O^{5+}$intensities in excess of 35 eμA have been extracted for periods up to 30 minutes. Approximately 0.15 cc/min of the easily ionized support gas is supplied to the ion source through a separate gas feed line and the primary gas flow is reduced by about 30%.

4 Claims, 5 Drawing Figures

METHOD OF ENHANCING CYCLOTRON BEAM INTENSITY

BACKGROUND OF THE INVENTION

This invention was made in the course of, or under, a contract with the U.S. Energy Research and Development Administration.

The present invention was conceived for use with isochronous cyclotrons such as the Oak Ridge Isochronous Cyclotron (ORIC) now in experimental use at the Oak Ridge National Laboratory. Details of the structure and operation of the ORIC systems may be obtained from *Nuclear Instruments and Methods,* 18, 19, Nov. 1962, pp. 46–61, 159–176, 303–308, and 601–605; from U.S. Pat. No. 3,624,527 issued Nov. 30, 1971; and from the Oak Ridge National Laboratory Electronuclear Division Annual Progress Report No. ORNL-3630, dated June 1964, pp. 38–62.

The ORIC system is provided with a magnetic field, an internal ion source provided with an arc chamber, a variable radio-frequency (rf) system including an rf accelerating slip for withdrawing ions from the ion source arc chamber, the rf system effecting the acceleration of the withdrawn ions through the cyclotron as guided by the magnetic field, and an ion beam extraction system for extracting a desired separated ion beam from the cyclotron such as described in the above publications.

A large portion of the operating time of the ORIC is assigned to the Heavy Element Research Program. In this program, beams of multiple-charge state ions such as $^{16}O^{5+}$ are used extensively to bombard target materials. Cold cathode sources are used in these cyclotrons to produce the ion beams and, in general, the current output is low and full startup takes 2 hours or longer.

Therefore, there exists a need to provide some means to increase the beam current of a cyclotron and in a shorter time period. The present invention was conceived to meet this need in a manner to be described hereinbelow.

SUMMARY OF THE INVENTION

It is the object of the present invention to provide an improved means to substantially increase the output of ions from a cyclotron in a shorter time period than was heretofore possible.

The above object has been accomplished in the present invention by adding an easily ionized support gas such as argon, krypton, or xenon to the plasma arc chamber of a cyclotron which results in a more stable plasma, and, more significantly, provides a substantial increase in beam intensity for elements of mass 20 and less. The enhanced beams are achieved by operating the cyclotron in the usual manner but with somewhat less gas flow than previously required, of which the added support gas comprises a small fraction.

DESCRIPTION OF THE PREFERRED EMBODIMENT

Figure 1:
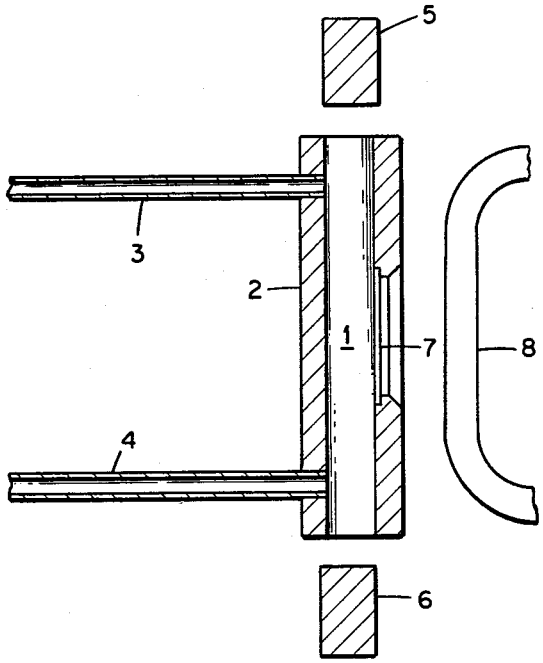
FIG. 1 is a sectional view of the ORIC arc chamber provided with two gas feed lines.

FIG. 1 illustrates the modification of the ORIC ion source for achieving the above object. As shown in FIG. 1, an anode 2 defines an arc chamber 1 bounded on respective ends thereof by the cathodes 5 and 6. The front face of the chamber 1 is provided with a tantalum insert 7 which is provided with a conventional accelerating slit for withdrawing ions from the arc chamber by means of an accelerating electrode 8 in a conventional manner. A pair of gas feed lines 3,4 are coupled to the arc chamber 1, as shown in the drawng. One of the gas feed lines is connected to a source of primary feed gas, not shown, and the other gas feed line is connected to a source of easily ionized support gas, not shown.

By utilizing the ion source of FIG. 1 in the ORIC and otherwise operating the cyclotron in the usual manner, it was discovered that by reducing the primary gas flow to the cyclotron ion source and adding a small amount of support gas, the cyclotron output beams were substantially increased above those which were previously attainable in the operation of the cyclotron. The results of operating the cyclotron with the ion source of FIG. 1 in the above manner is illustrated in FIGS. 2–5, which will now be described.

Figure 2:
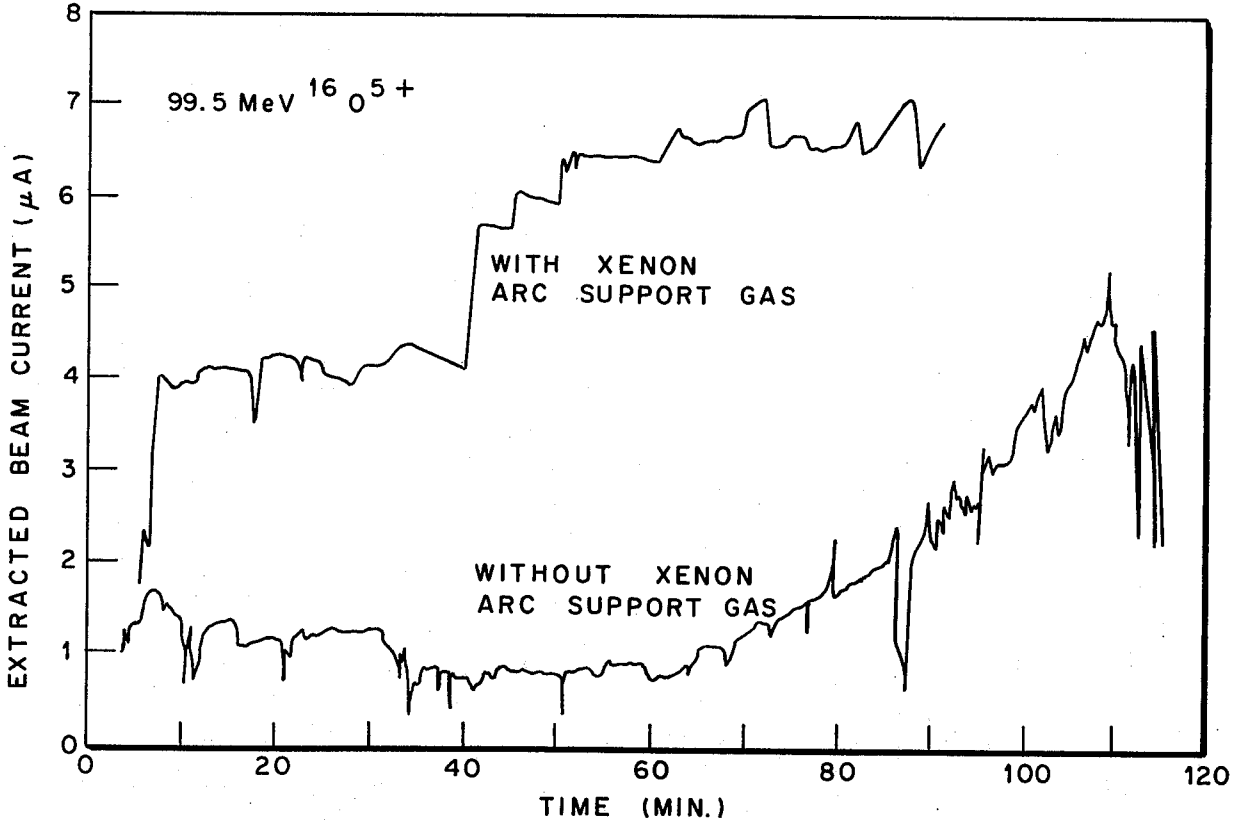
FIG. 2 is a graph on which is plotted the cyclotron extracted beam current as a function of time for the 99.5 MeV $^{16}O^{5+}$ beam with and without the xenon arc support gas.

In FIG. 2, the beam intensity (extracted beam current) is plotted as a function of time for the 99.5 MeV $^{16}O^{5+}$beam with and without arc support gas (xenon) to the cyclotron. The lower curve shows the usual beam intensity when xenon support gas is not used. The current increases slowly until the ion source has been on for an hour or more. Then, the current increases fairly rapidly, but even after 2 hours the current barely exceeds 4 electrical microamperes (eμA). When xenon is added as a support gas and the primary gas is reduced slightly, the beam current (upper curve) increases rapidly to about 4 eμA in the first 10 minutes where it can be held by controlling the oxygen gas supplied to the ion source. After stable operation for about 30 minutes, the support gas can be reduced further and the current is observed to increase to about 6–7 eμA. Typically, as the source ages, it is necessary to add oxygen to the source to hold the beam current down.

In one particular striking test, again with oxygen, after the source had been on for 40 minutes and was producing a current of 0.7 eμA, a small amount of xenon gas was added to the ion source. Within 5 minutes the current was 9 eμA, and after another 10 minutes the current rose to 35 eμA. This current was then held 30 minutes before going on to other tests.

In another test, using $^{20}Ne^{7+}$, the maximum current on an experimenter's target was 0.05 enA before xenon was added to the arc chamber, and the amount of beam available soon increased to 27 enA when xenon was added. Eventually, a sustained current of 300 enA was recorded.

Figure 3:
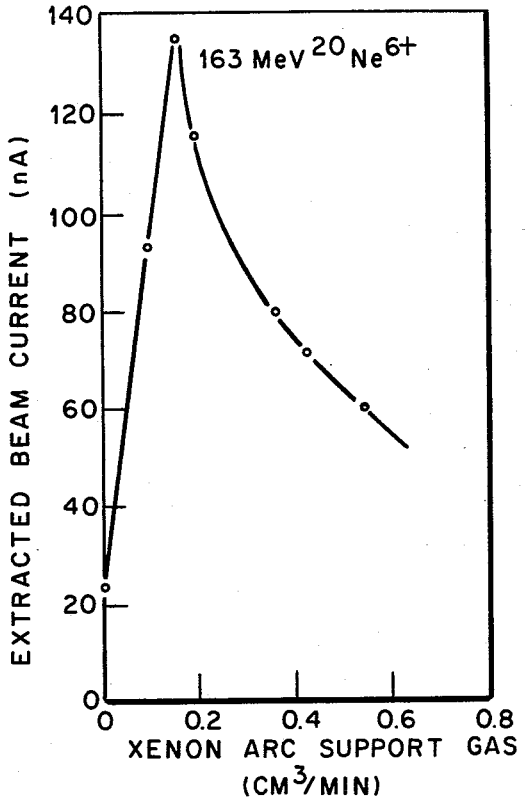
FIG. 3 is a graph illustrating the production of a 163 MeV $^{20}Ne^{6+}$ beam as a function of the amount of xenon arc support gas fed to the cyclotron ion source.
Figure 4:
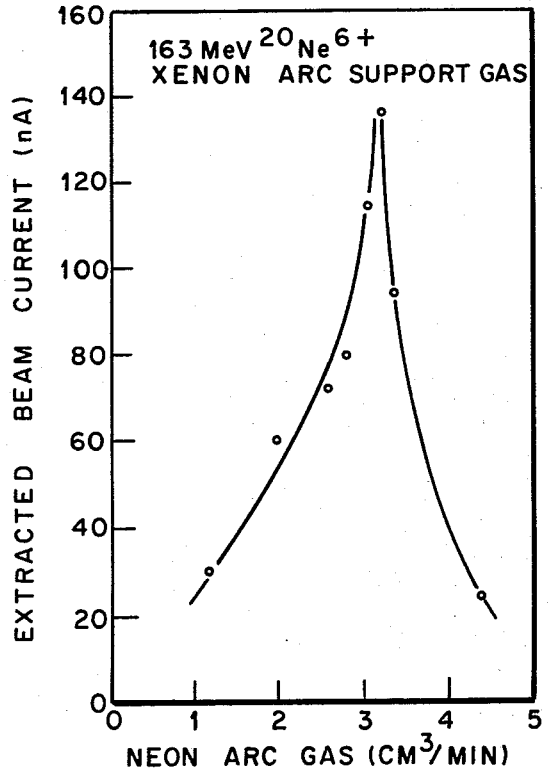
FIG. 4 is a graph illustrating the production of a 163 MeV $^{20}Ne^{6+}$ beam as a function of the amount of neon arc gas fed to the cyclotron ion source.

FIGS. 3 and 4 show the amount of xenon arc support gas and neon arc gas, respectively, typical of values used in the production of $^{20}Ne^{6+}$beams. The results shown in FIG. 3 were produced by reducing the neon gas as the xenon gas was added so as to maintain the same arc voltage and current. The beam reached its maximum intensity when about 0.15 cc/min of xenon was used, corresponding to a gas mixture of about 5% xenon. In FIG. 4, the beam intensity is plotted as a function of the neon gas flow to the plasma. The xenon support gas enabled the neon flow to be reduced about 30% while added the xenon.

Figure 5:
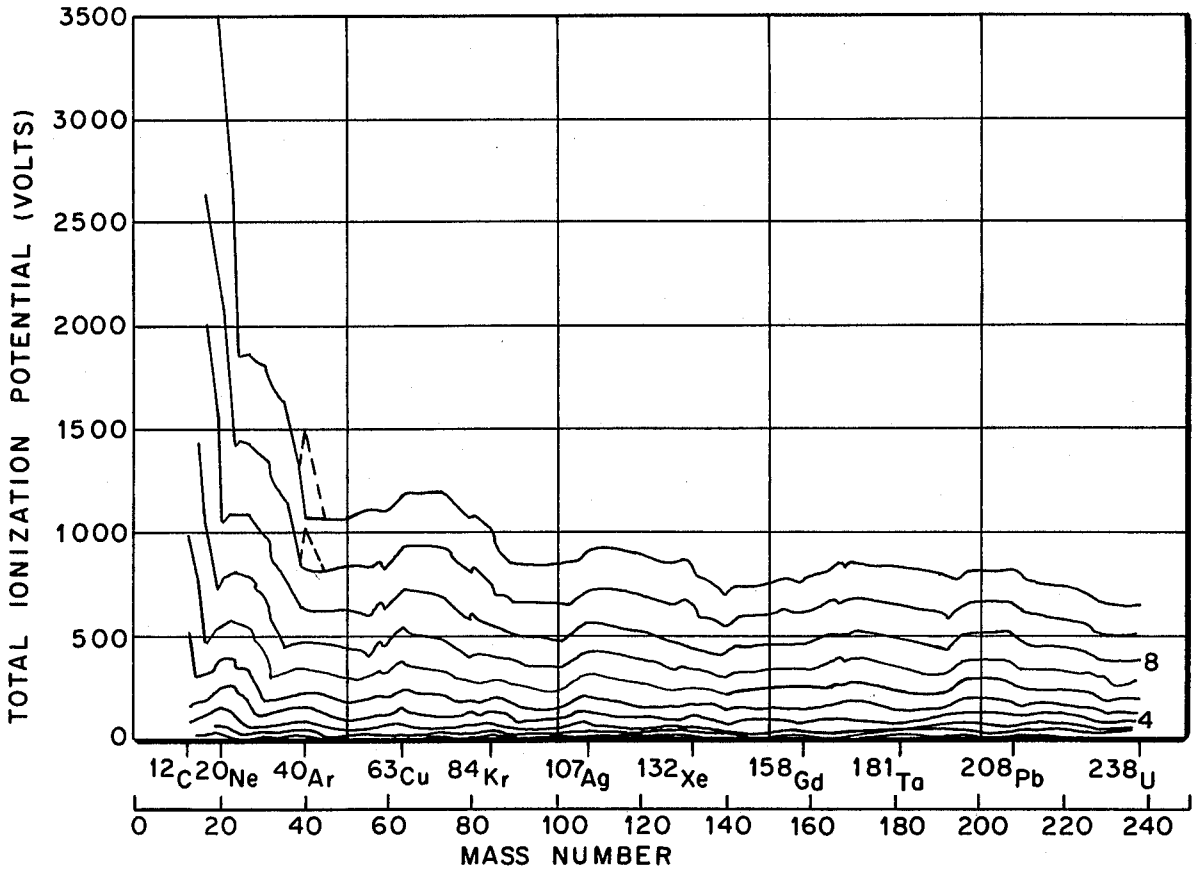
FIG. 5 is a graph in which the total ionization potential is plotted against mass for charge states through 10.

It is believed that the greater ionization efficiency of the heavier support gas (i.e., higher average charge state for a given electron impact) apparently provides more efficient heating of the cathodes thus permitting the reduced flow of the primary gas. The data of FIG. 5 would seem to support such a contention. In FIG. 5, total ionization potential is plotted against mass for charge states through 10. Above mass 30, the ionization potential is fairly constant. However, below mass 20, the ionization potential is about doubled for most higher charges states. This indicates, for example, that it should be much easier to make 4+ xenon than 4+ neon. It thus follows that should the same cathode temperature be maintained using the easier ionized gas, the plasma pressure (primary gas flow to the plasma) can be reduced as a result.

It should be understood that the present invention is not limited to the use of xenon as the support gas. For example, it has been determined that either krypton or argon can be utilized as the support gas with about the same beam enhancement being achieved as was achieved with the xenon support gas.

It should also be understood that, if desired, the two gases may be mixed externally and supplied to the ion source arc chamber through only one of the gas lines.

This invention has been described by way of illustration rather than by limitation and it should be apparent that it is equally applicable in fields other than those described.

What is claimed is:

1. In a method of operating an isochronous cyclotron comprising the steps of feeding a desired primary feed gas at a selected feed rate to the internal ion source of said cyclotron for producing a plasma of ions in the arc chamber of said ion source; withdrawing and accelerating ions from said arc chamber with the rf system and magnetic field of said cyclotron; and extracting a desired separated ion beam from said accelerated ions in said cyclotron with the ion beam extraction system of said cyclotron, the improvement comprising the steps of feeding a small amount of an easily ionized arc support gas to said arc chamber simultaneously with said feeding of said primary feed gas to said arc chamber, and at the same time reducing the feed rate of said primary feed gas to said arc chamber to a desired lower value such as to maintain the arc voltage and arc current of said ion source at constant values, whereby the desired separated ion beam extracted from said cyclotron has its intensity substantially enhanced over that achievable without the use of said arc support gas.

2. The method set forth in claim 1, wherein said arc support gas is selected from the group consisting essentially of xenon, krypton, and argon.

3. The method set forth in claim 2, wherein said selected arc support gas is xenon.

4. The method set forth in claim 3, wherein said feed rate of primary feed gas is reduced about 30% to provide said desired lower value thereof, and said small amount of said arc support gas is about 5% or less of the total gas supply to said arc chamber.

* * * * *